US007070895B2

(12) United States Patent
Lim et al.

(10) Patent No.: US 7,070,895 B2
(45) Date of Patent: Jul. 4, 2006

(54) MAGNETIC TONER COMPOSITION HAVING SUPERIOR ELECTRIFICATION HOMOGENEITY

(75) Inventors: In-Hee Lim, Seoul (KR); Chang-Soon Lee, Daejeon (KR); Won-Sup Lee, Daejeon (KR)

(73) Assignee: LG Chem, Ltd. (KR)

( * ) Notice: Subject to any disclaimer, the term of this patent is extended or adjusted under 35 U.S.C. 154(b) by 0 days.

(21) Appl. No.: 10/468,189

(22) PCT Filed: Dec. 20, 2002

(86) PCT No.: PCT/KR02/02405

§ 371 (c)(1),
(2), (4) Date: Aug. 15, 2003

(87) PCT Pub. No.: WO03/054633

PCT Pub. Date: Jul. 3, 2003

(65) Prior Publication Data

US 2004/0234880 A1 Nov. 25, 2004

(30) Foreign Application Priority Data

Dec. 20, 2001 (KR) ..... 10-2001-0081623
Dec. 18, 2002 (KR) ..... 10-2002-0081221

(51) Int. Cl.
*G03G 9/083* (2006.01)

(52) U.S. Cl. ..... 430/106.2; 430/108.6; 430/108.7; 430/108.9

(58) Field of Classification Search ..... 430/108.6, 430/108.7, 108.9, 106.1, 106.2, 108.1
See application file for complete search history.

(56) References Cited

U.S. PATENT DOCUMENTS

| | | | | | |
|---|---|---|---|---|---|
| 5,541,030 | A | * | 7/1996 | Sano et al. | 430/109.4 |
| 5,695,902 | A | * | 12/1997 | Mikuriya et al. | 430/108.6 |
| 5,702,858 | A | * | 12/1997 | Yuasa et al. | 430/108.6 |
| 5,879,846 | A | * | 3/1999 | Watanuki et al. | 430/55 |
| 6,156,471 | A | * | 12/2000 | Kokori et al. | 430/108.6 |

FOREIGN PATENT DOCUMENTS

| | | |
|---|---|---|
| KR | 1998-081025 | 11/1998 |
| KR | 10-0184559 | 12/1998 |
| KR | 2000-0076499 | 12/2000 |
| KR | 2002-0039858 | 5/2002 |

OTHER PUBLICATIONS

PCT International Search Report; International Application No. PCT/KR02/02405; International Filing Date: Dec. 20, 2002; Date of Mailing: Apr. 17, 2003.

* cited by examiner

*Primary Examiner*—Janis L. Dote
(74) *Attorney, Agent, or Firm*—Cantor Colburn LLP

(57) ABSTRACT

The present invention relates to a magnetic toner composition, and more particularly to a magnetic toner composition having an improved chargeability and excellent uniform chargeability, and that is capable of reducing a difference in electrostatic charge between a toner remaining in a cartridge or in a developing unit and that of a newly supplied toner. A magnetic toner composition of the present invention comprises magnetic toner particulate comprising a binder resin and a magnetic substance, a conductive fine powder having a specific surface area of 30 to 300 $m^2/g$, a hydrophobic silica having a specific surface area of 100 to 240 $m^2/g$, and an inorganic fine powder having an average diameter of 0.1 to 4.O μm.

8 Claims, No Drawings

MAGNETIC TONER COMPOSITION HAVING SUPERIOR ELECTRIFICATION HOMOGENEITY

BACKGROUND OF THE INVENTION (a) Field of the Invention

The present invention relates to a magnetic toner composition, and more particularly to a magnetic toner composition having an improved chargeability and excellent uniform chargeability, and that is capable of reducing a difference in electrostatic charge between a toner remaining in a cartridge or in a developing unit and, that of a newly supplied toner.

(b) Description of the Related Art

The magnetic toner is used for developing latent images in electrophotography, electrostatic recording, electrostatic printing, etc.

In recent years, there has been high growth rate of printers and copiers with advanced technologies of PC and OA equipments. A method of forming a latent image has been widely used in many printers and copiers.

Generally, a fixed image is formed by the following processes:

1. An charge process of evenly offering an electrostatic charge to a photoconductive insulating layer made of a photo-conductive material;

2. An exposure process of forming latent image on the photoconductive member surface using light or laser beam;

3. A developing process of forming a toner image by developing the latent image using a developer;

4. A transfer process of transferring the obtained toner image to a transfer medium such as paper;

5. A fixing process of permanently fixing the transferred toner by heating or pressure application; and 6. A cleaning process of cleaning toners and adsorbents remaining on the photoconductive member.

The above-mentioned processes are repeated for successive image formation such as printed and copied sheets.

In the developing process above, a electrostatic charge is offered to the toner. For a two-component toner, the electrostatic charge is offered by mixing a carrier comprising ferrite with the toner. For mono-component toner, the electrostatic charge is offered by passing the toner through a narrow gap such as a sleeve and a doctor blade.

The toner to which the electrostatic charge is offered remains in a toner cartridge or in a developing unit, and a electrostatic charge is offered to the toner inside the cartridge or the developing unit by mixing with a agitating bar or agitating roller. A toner sensor inside the cartridge or in the developing unit detects existence of toners, and if the amount of remaining toners down small amounts, the toner sensor requests for supply of toner. If new toner is supplied, it is mixed with the toner remaining in the cartridge or in the developing unit. At this time, the newly supplied toner has no electrostatic charge while the remaining toner has been offered a electrostatic charge. The difference in electrostatic charge of the remaining toner and newly supplied toner causes blurred or nonuniform copying or printing images.

Accordingly, a magnetic toner composition having a uniform chargeability and excellent uniforn electrification, and that is therefore capable of reducing a electrostatic charge difference between the toner remaining in the cartridge or in the developing unit and a newly supplied toner, is highly required.

SUMMARY OF THE INVENTION

An object of the present invention is to provide a magnetic toner composition having an improved electrification property and execllent uniform electrification, and that is capable of reducing a difference between a electrostatic charge of a toner remaining in a cartridge or in a developing and that of a newly supplied toner.

To attain this object, the present invention provides a magnetic toner composition, which comprises:

a) magnetic toner particulate comprising binder resin and a magnetic substance;

b) a conductive fine powder having a specific surface area of 30 to 300 $m^2/g$;

c) a hydrophobic silica having a specific surface area of 100 to 240 $m^2/g$; and d) an inorganic fine powder having an average diameter of 0.1 to 4.0 μm.

DETAILED DESCRIPTION OF THE PREFERRED EMBODIMENTS

Hereinafter, the present invention is described in more detail.

The present inventors have worked for a method of reducing a difference in electrostatic charge between a toner remaining in a cartridge or in a developing unit and that of a newly supplied toner. In doing so, they realized that a magnetic toner prepared by adding a conductive fine powder, a hydrophobic silica, and an inorganic fine powder to magnetic toner particulate has an improved chargeability and a uniform electrification property, and that it is capable of reducing a electrostatic charge difference between the toners.

The present invention relates to a magnetic toner composition, which comprises: magnetic toner particulate comprising binder resin and a magnetite; a conductive fine powder having a specific surface area of 30 to 300 $m^2/g$; a hydrophobic silica having a specific surface area of 100 to 240 $m^2/g$;, and an inorganic fine powder having an average diameter of 0.1 to 4.0 μm.

For the conductive fine powder having a specific surface area of 30 to 300 $m^2/g$, a metal oxide fine powder or conductive carbon black can be used. For the metal oxide fine powder, magnetite, aluminum oxide, titanium oxide, tin oxide, zinc oxide, indium oxide, or a mixture thereof can be used.

Preferably, the specific surface area of the conductive fine powder is 30 to 300 $m^2/g$, and more preferably, 100 to 250 $m^2/g$. If the specific surface area is below 30 $m^2/g$, the conductive fine powder becomes insufficient on the surface of the toner particulate and the uniform electrification is reduced. Otherwise, if it exceeds 300 $m^2/g$, attraction between the conductive fine powder particles increases, so that they separate from the surface of the toner particulate. This causes image deterioration and worsens uniform electrification.

Preferably, the electric resistance of the conductive fine powder is $10^{-2}$ to 10Ω·cm. If the electric resistance is below $10^{-2}$Ω·cm, the conductive fine powder interrupts electrification of the toner particulate, and therefore lower image density is obtained. Otherwise, if it exceeds 10Ω·cm, it is difficult to offer uniform electrification to the toner particulate, and therefore the printing image becomes nonuniform due to a difference in electrostatic charge between the remaining toner and that of the newly supplied toner.

Preferably, the conductive fine powder is comprised at 0.1 to 0.5 wt %, more preferably 0.15 to 0.35 wt %, for 100 wt % of the toner particulate. If its content is below 0.1 wt %, conductive fine powder layer formation on the surface of the toner particulate becomes insufficient, and therefore the uniform electrification is reduced. Otherwise, if it exceeds 0.5 wt %, frictional electrification between the magnetic toner and the developing sleeve becomes difficult, and therefore uniform electrification of the toner particles worsens causing low image density.

The magnetic toner can have uniform electrification by using a mono-component developer wherein a conductive fine powder of 30 to 300 $m^2/g$ of is added to the surface of the magnetic toner particulate. The electrostatic charge is offered to the magnetic toner by a agitating bar or a agitating roller in a cartridge or in a developing. The amount of electrostatic charge offered to the magnetic toner depends on the binder resin, magnetite, or charge control agent in the toner particulate. A particle size distribution of the toner particulate induces electrostatic charge distribution of the toner particulate, so that variation of electrostatic charge arises. A magnetic toner composition of the present invention reduces the electrostatic charge difference of the toner particulate through the conductive fine powder present on surface of the toner particulate. Therefore, it prevents blurred or nonuniform copying or printing of images. Also, it reduces a difference in electrostatic charge of a toner remaining in a cartridge or in a developing unit and that of a newly supplied toner, thereby preventing nonuniform images.

The hydrophobic silica having a specific surface area of 100 to 240 $m^2/g$ improves flowability and the chargeability of the toner particles.

Preferably, the specific surface area of the hydrophobic silica is 100 to 240 $m^2/g$, and more preferably, 130 to 200 $m^2/g$. If the specific surface area is below 100 $m^2/g$, the toner has insufficient flowability, and therefore nonuniform may form when a lot of solid images are printed. Otherwise, if it exceeds 240 $m^2/g$, the toner has insufficient flowability because the silica becomes embeded on the surface of the toner particulate, and reduces the effect of the conductive fine powder and the inorganic fine powder.

Preferably, the hydrophobic silica is comprised at 0.1 to 0.5 wt % for 100 wt % of the toner particulate. If its content is below 0.1 wt %, flowability of the toner becomes insufficient. Otherwise, if it exceeds 0.5 wt %, uniform electrification of the toner particulate is reduced.

For the inorganic fine powder having an average diameter of 0.1 to 4.0 μm, an inorganic oxide fine powder or carbonate compound fine powder can be used. For the inorganic oxide, a monoxide like zinc oxide or tin oxide; a dioxide like strontium titanate, barium titanate, calcium titanate, strontium zirconate, or calcium zirconate; or a carbonate compound like calcium carbonate or magnesium carbonate can be used.

Preferably, an average diameter of the inorganic fine powder is 0.1 to 4.0 μm, and more preferably, 0.2 to 3.0 μm. If the average diameter is below 0.1 μm, attraction to the magnetic toner surface becomes excessive, and therefore it does not separate from the magnetic toner surface well. As a result, the abrasion effect reduces and toner filming on the latent image carrier material cannot be prevented. If the average diameter exceeds 4.0 μm, it does not fully mix with the magnetic toner. Therefore, it easily disparted on the sleeve surface and reduces image density by contaminating the developing roller. Additionally, although toner filming on the latent image carrier can be prevented, an inorganic fine powder having a large diameter easily scratches the latent image carrier material surface.

Preferably, the inorganic fine powder is comprised at 0.5 to 1.5 wt %, more preferably in 0.7 to 1.2 wt %, for 100 wt % of the magnetic toner particulate. If its content is below 0.5 wt %, formation of inorganic fine powder layer on the developing sleeve becomes insufficient, and therefore it is difficult to prevent toner filming on the latent image carrier material. Otherwise, if it exceeds 1.5 wt %, the image density reduces because frictional electrification between the magnetic toner and the developing sleeve is difficult.

The magnetic toner particulate comprise binder resin and a magnetic substance. The magnetic toner particulate may further comprise a colorant or additives.

For the binder resin, commonly known binder resins can be used. To be specific, polyester resin, styrene based resin, acryl based resin, styrene acryl based resin, epoxy resin, polyamide resin, polyethylene resin, styrene vinyl acetate resin, or a mixture thereof can be used. Preferably, the binder resin is comprised at 25 to 75 wt % for 100 wt % of the magnetic toner particulate.

For the magnetic substance, a ferromagnetic element or an alloy or compound thereof, or a granular magnetic substance or a acute magnetic substance can be used. To be specific, an alloy or compound of magnetite, hematite, ferrite, iron, cobalt, nickel or manganese, or a ferromagnetic alloy or magnetic oxide can be used. Preferably, the magnetic substance is a fine powder having an average diameter of less than 1 μm, and it is comprised for a electrostatic charge image at 20 to 70 wt % for 100 wt % of the magnetic toner particulate.

For the colorant, split black, nigrosine dye, aniline blue, chrome yellow, phthalocyanine blue, lamp black, rose bengal, navy blue, or methylene blue chloride can be used. Preferably, the colorant is comprised at less than 10 wt % for 100 wt % of the magnetic toner particulate.

For the additives, a conventional charge control agent; a lubricant such as polytetrafluoroethylene (teflon), polyfluorovinylidene, or a fatty acid metal salt; a flowability agent such as titanium dioxide or aluminum oxide treated with a surface-treating agent like an abrasive, such as cerium oxide and silicon carbide, silicon oil, modified silicon oil, or a silane coupling agent; an anti-caking agent; a fixing agent such as carbon black; or a low-molecular-weight polyethylene can be used. Also, a release agent, such as low-molecular-weight polyethylene, low-molecular-weight polypropylene, and carnauba wax can be used to improve the release property during fixing in the heating roller.

Preferably, the average diameter of the magnetic toner particulate is 5 to 12 μm.

Preferably, the magnetic toner composition according to the present invention is used for electrostatic charge image development.

Hereinafter, the present invention is described in more detail through Examples and Comparative Examples. However, the following Examples are only for the understanding of the present invention, and the present invention is not limited by the following Examples.

EXAMPLES

Example 1

(preparation of magnetic toner particulate)

54 wt % of styrene acryl resin and 5 wt % of polypropylene resin as a binder resin, 1 wt % of metal complex dye powder as a charge control agent, and 40 wt % of magnetite as a magnetic substance were mixed in a Henschel mixer, and melt mixed using an extruder. The kneaded product was cooled, coarsely crushed by hammer mill and finely pulverized by a jet mill The pulverized product was classified by pneumatic classifier to obtain magnetic toner particulate having a weight-average particle diameter of 7.5 μm.

(preparation of magnetic toner)

0.2 wt % of a conductive fine powder having a specific surface area of 30 $m^2/g$ and an electric resistance of $10^{-1}$ to $10^{-2}\Omega\cdot cm$, 0.5 wt % of P25 (Degussa; Germany) as an inorganic fine powder, and 0.5 wt % of RA200HS as a hydrophobic silica were added to the prepared toner particulate. The mixture was mixed in a Henschel mixer for 5 minutes to obtain a magnetic toner for electrostatic charge image development system.

Examples 2 to 12 and Comparative Examples 1 to 14

The procedure of Example 1 was carried out with the contents shown in the following Table 1.

TABLE 1

| | Conductive Fine powder | | | Inorganic Fine powder | | Silica | |
|---|---|---|---|---|---|---|---|
| Classification | Specific surface area ($m^2/g$) | Electric resistance ($\Omega \cdot cm$) | Wt % | Average particle diameter (μm) | Wt % | Specific surface area ($m^2/g$) | Wt % |
| Example 1 | 30 | $10^{-1}$ to $10^{-2}$ | 0.2 | 0.5 | 0.5 | 130 | 0.5 |
| Example 2 | 100 | 1 to 5 | 0.2 | 0.5 | 0.5 | 130 | 0.5 |
| Example 3 | 250 | $10^{-1}$ to $10^{-2}$ | 0.2 | 0.5 | 0.5 | 130 | 0.5 |
| Example 4 | 250 | $10^{-1}$ to $10^{-2}$ | 0.1 | 0.5 | 0.5 | 130 | 0.5 |
| Example 5 | 30 | $10^{-1}$ to $10^{-2}$ | 0.1 | 0.5 | 0.5 | 130 | 0.5 |
| Example 6 | 250 | $10^{-1}$ to $10^{-2}$ | 0.5 | 0.5 | 0.5 | 130 | 0.5 |
| Example 7 | 30 | $10^{-1}$ to $10^{-2}$ | 0.5 | 0.5 | 0.5 | 130 | 0.5 |
| Example 8 | 250 | $10^{-1}$ to $10^{-2}$ | 0.2 | 0.5 | 1.5 | 130 | 0.5 |
| Example 9 | 250 | $10^{-1}$ to $10^{-2}$ | 0.2 | 0.5 | 1.0 | 130 | 0.1 |
| Example 10 | 250 | $10^{-1}$ to $10^{-2}$ | 0.1 | 0.5 | 0.5 | 130 | 0.1 |
| Example 11 | 60 | $10^{-1}$ to $10^{-2}$ | 0.2 | 0.5 | 0.5 | 130 | 0.5 |
| Example 12 | 60 | $10^{-1}$ to $10^{-2}$ | 0.5 | 0.5 | 0.5 | 130 | 0.5 |
| Comp. Example 1 | — | — | — | 0.5 | 0.2 | 130 | 0.5 |
| Comp. Example 2 | 400 | $10^{-1}$ to 1 | 0.2 | 0.5 | 0.5 | 130 | 0.5 |
| Comp. Example 3 | 550 | $10^{-1}$ to $10^{-2}$ | 0.2 | 0.5 | 0.5 | 130 | 0.5 |
| Comp. Example 4 | 15 | $10^{-1}$ to 1 | 0.2 | 0.5 | 0.5 | 130 | 0.5 |
| Comp. Example 5 | 250 | $10^{-1}$ to $10^{-2}$ | 1.0 | 0.5 | 1.0 | 130 | 0.5 |
| Comp. Example 6 | 250 | $10^{-1}$ to $10^{-2}$ | 0.2 | 0.5 | — | 130 | 0.5 |
| Comp. Example 7 | 250 | $10^{-1}$ to $10^{-2}$ | 0.2 | 0.5 | 0.2 | 130 | — |
| Comp. Example 8 | 250 | $10^{-1}$ to $10^{-2}$ | 0.2 | 0.5 | 2.0 | 130 | 0.5 |
| Comp. Example 9 | 250 | $10^{-1}$ to $10^{-2}$ | 0.2 | 0.05 | 0.5 | 130 | 0.5 |
| Comp. Example 10 | 250 | $10^{-1}$ to $10^{-2}$ | 0.2 | 5.0 | 0.5 | 130 | 0.5 |

TABLE 1-continued

| Classification | Conductive Fine powder | | | Inorganic Fine powder | | Silica | |
|---|---|---|---|---|---|---|---|
| | Specific surface area ($m^2/g$) | Electric resistance ($\Omega \cdot cm$) | Wt % | Average particle diameter (μm) | Wt % | Specific surface area ($m^2/g$) | Wt % |
| Comp. Example 11 | 250 | $10^{-1}$ to $10^{-2}$ | 0.2 | 0.5 | 0.5 | 130 | 0.05 |
| Comp. Example 12 | 250 | $10^{-1}$ to $10^{-2}$ | 0.2 | 0.5 | 0.5 | 130 | 1.0 |
| Comp. Example 13 | 250 | $10^{-1}$ to $10^{-2}$ | 0.2 | 0.5 | 0.5 | 50 | 0.5 |
| Comp. Example 14 | 250 | $10^{-1}$ to $10^{-2}$ | 0.2 | 0.5 | 0.5 | 300 | 0.5 |

Test Example

The magnetic toners prepared in Examples 1 to 12 and Comparative Examples 1 to 14 were each put in a magnetic mono-component developing type digital copier (GP-605; Canon). New toner was supplied when the toner was in the developer. 20,000 sheets of paper were copied under normal temperature and humidity (20° C.; 55% RH). Filming and damage of the photocoductive member, image density, and scattering in the machine were determined by the following standard. The results are shown in the following Table 2.

| Evaluation Standard | Filming of photo-conductive member | Damage of photo-conductive member | Image Density | Scattering in the machine |
|---|---|---|---|---|
| A | None | None | Maintained | None |
| B | Observed for 5,000 pages | Slight | Reduced after 5,000 pages | Observed for 10,000 pages |
| C | Observed for 10,000 pages | Damage observed | Reduced after 2,000 pages | Observed for 5,000 pages |

TABLE 2

| Classification | Filming of photo-conductive member | Damage of photo-conductive member | Image Density | Scattering in the machine |
|---|---|---|---|---|
| Example 1 | A | A | A | A |
| Example 2 | A | A | A | A |
| Example 3 | A | A | A | A |
| Example 4 | A | A | A | A |
| Example 5 | A | A | A | A |
| Example 6 | A | A | A | A |
| Example 7 | A | A | A | A |
| Example 8 | A | A | A | A |
| Example 9 | A | A | A | A |
| Example 10 | A | A | A | A |
| Example 11 | A | A | A | A |
| Example 12 | A | A | A | A |
| Comp. Example 1 | A | A | C | A |
| Comp. Example 2 | A | A | A | A |
| Comp. Example 3 | C | A | C | A |
| Comp. Example 4 | A | B | C | B |
| Comp. Example 5 | A | B | A | A |

TABLE 2-continued

| Classification | Filming of photo-conductive member | Damage of photo-conductive member | Image Density | Scattering in the machine |
|---|---|---|---|---|
| Comp. Example 6 | B | B | A | C |
| Comp. Example 7 | A | A | B | A |
| Comp. Example 8 | A | A | B | C |
| Comp. Example 9 | B | C | C | A |
| Comp. Example 10 | B | A | C | C |
| Comp. Example 11 | C | A | B | A |
| Comp. Example 12 | A | A | B | A |
| Comp. Example 13 | A | B | B | A |
| Comp. Example 14 | C | C | B | A |

As seen in Table 2, magnetic toner compositions according to the present invention (Examples 1 to 12) were superior in terms of filming and damage of the photoconductive member, image density, and scattering in the machine to those of Comparative Examples 1 to 14.

As described above, a magnetic toner composition of the present invention has improved chargeability and excellent uniform chargeability, and it is capable of reducing a difference in electrostatic charge between a toner remaining in a cartridge or in a developing unit and that of a newly supplied toner.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A magnetic toner composition, which comprises:

magnetic toner particulate comprising a binder resin and a magnetic substance;

a conductive fine powder having a specific surface area of 100 to 250 $m^2/g$ and electric resistance of $10^{-2}$ to 10 $\Omega \cdot cm$;

a hydrophobic silica having a specific surface area of 100 to 240 $m^2/g$; and an inorganic fine powder having an average diameter of 0.1 to 4.0 μm.

2. The magnetic toner composition according to claim 1, which comprises:

100 wt % of magnetic toner particulate comprising the binder resin and the magnetic substance:

0.1 to 0.5 wt % of the conductive fine powder having a specific surface area of 100 to 250 $m^2/g$, based on the 100 wt % of the magnetic toner particulate;

0.1 to 0.5 wt % of the hydrophobic silica having specific surface area of 100 to 240 $m^2/g$, based on the 100 wt % of the magnetic toner particulate; and 0.5 to 1.5 wt % of the inorganic fine powder having an average diameter of 0.1 to 4.0 μm, based on the 100 wt % of the magnetic toner particulate.

3. The magnetic toner composition according to claim 1, wherein the conductive fine powder having a specific surface area of 100 to 250 $m^2/g$ is a metal oxide fine powder or conductive carbon black.

4. The magnetic toner composition according to claim 3, wherein the metal oxide fine powder is one or more substances selected from a group consisting of magnetite, aluminum oxide, titanium oxide, tin oxide, zinc oxide, indium oxide, and mixture thereof.

5. The magnetic toner composition according to claim 1, wherein the inorganic fine powder having an average diameter of 0.1 to 4.0 μm is selected from a group consisting of zinc oxide, tin oxide, strontium titanate, barium titanate, calcium titanate, strontium zirconate, calcium zirconate, calcium carbonate, and magnesium carbonate.

6. The magnetic toner composition according to claim 1, wherein the magnetic toner particulate comprise 25 to 75 wt % of the binder resin and 20 to 70 wt % of the magnetic substance, based on 100 wt % of the magnetic toner particulate.

7. The magnetic toner composition according to claim 6, wherein the magnetic toner particulate further comprise a charge control agent, a lubricant, an anti-caking agent, a fixing agent, or a release agent.

8. The magnetic toner composition according to claim 1, wherein the average diameter of the magnetic toner particulate 5 to 12 μm.

* * * * *